US005930103A

United States Patent [19]

Heck

[11] Patent Number: 5,930,103

[45] Date of Patent: Jul. 27, 1999

[54] CONTROL CIRCUIT FOR AN ELECTROMECHANICAL DEVICE

[75] Inventor: Karl R. Heck, Phoenix, Ariz.

[73] Assignee: Motorola, Inc., Schaumburg, Ill.

[21] Appl. No.: 09/032,926

[22] Filed: Mar. 2, 1998

[51] Int. Cl.[6] ..... H01H 47/28

[52] U.S. Cl. ..... 361/187; 361/153; 123/478

[58] Field of Search ..... 361/152–156, 361/160, 170, 182, 184, 195, 196, 203, 187; 318/129, 130, 127, 128; 123/478, 491, 490, 499

[56] References Cited

U.S. PATENT DOCUMENTS

| | | | |
|---|---|---|---|
| 4,243,921 | 1/1981 | Tamura et al. | 318/314 |
| 4,347,544 | 8/1982 | Ohba | 361/154 |
| 4,381,481 | 4/1983 | Kuppers et al. | 318/696 |
| 4,393,845 | 7/1983 | Seitz | 123/478 |
| 4,402,299 | 9/1983 | Nakao et al. | 123/632 |
| 4,545,257 | 10/1985 | Tomita | 73/861.17 |
| 5,126,647 | 6/1992 | Blackburn et al. | 318/599 |
| 5,689,162 | 11/1997 | Li | 318/599 |
| 5,764,039 | 6/1998 | Choi et al. | 323/222 |

*Primary Examiner*—Jeffrey Gaffin
*Assistant Examiner*—Kim Huynh
*Attorney, Agent, or Firm*—Robert F. Hightower; Anthony M. Martinez

[57] ABSTRACT

A circuit for controlling current flow ($I_{COIL}$) through a coil of an electromechanical device (101) uses a first timer (118) to measure the pulse width of a first drive pulse (22) and to store a proportional first value at an output (121). A second timer (124) receives the first value and generates a second value less than the first value to represent a time interval shorter than the pulse width of the first drive pulse. The second timer initiates the time interval with a second drive pulse (24) and provides a sampling signal ($V_{SAMPLE}$) as the time interval terminates to sense an average current flow through the coil before the second drive pulse terminates.

20 Claims, 3 Drawing Sheets

100
$V_{BAT}$
101
ACTUATOR
$I_{COIL}$
106
110
108
112
116
104
DRIVE CIRCUIT
$V_{SENSE}$
114
$V_{CONTROL}$
RIGHT/LEFT
141
PULSE GENERATOR
$V_{DRIVE}$
143
102
$V_{SAMPLE}$
128
PULSE SHORTENER
SPEED
103
125
130
CLK
EN
COUNTER
118
121
DIVIDER
122
123
CLK
EN
COUNTER
LOAD
124
126
$V_{SYSCLK}$
$V_{SYSCLK}$

CONTROL CIRCUIT FOR AN ELECTROMECHANICAL DEVICE

BACKGROUND OF THE INVENTION

The present invention relates in general to semiconductors and, more particularly, to a semiconductor control circuit for an electromechanical device.

Linear actuators are electromechanical devices having a component that undergoes a linear displacement when a current is applied through a coil of the actuator. A typical bidirectional linear actuator includes a spring loaded piston surrounded by a solenoid coil. Pulse width modulated voltage pulses are applied across the coil with an H-bridge transistor network to induce a magnetic field with the coil current. The magnetic field displaces the piston a distance proportional to the average value of the coil current. The displacement is controlled by sensing and controlling the average current through the coil.

Prior art actuators sense the coil current by routing the coil current through two sense resistors, each coupled to an end of the H-bridge, and measuring the voltages across the resistors. Current is measured at the beginning and the end of each voltage pulse, where the coil current reaches maximum and minimum levels, and the average current is computed from these measurements. This method is reasonably accurate, but suffers from high cost due to the need for two external resistors and complex sensing circuitry to derive the average current value from the two measurements. Other prior art schemes use only one external resistor connected directly to the coil, but have low accuracy due to large common mode voltage swings across the resistor.

Hence, there is a need for an integrated circuit for controlling an electromechanical device that can detect the average coil current at a lower cost while maintaining high accuracy.

DETAILED DESCRIPTION OF THE DRAWINGS

In the figures, elements having the same reference numbers perform similar functions.

Figure 1:
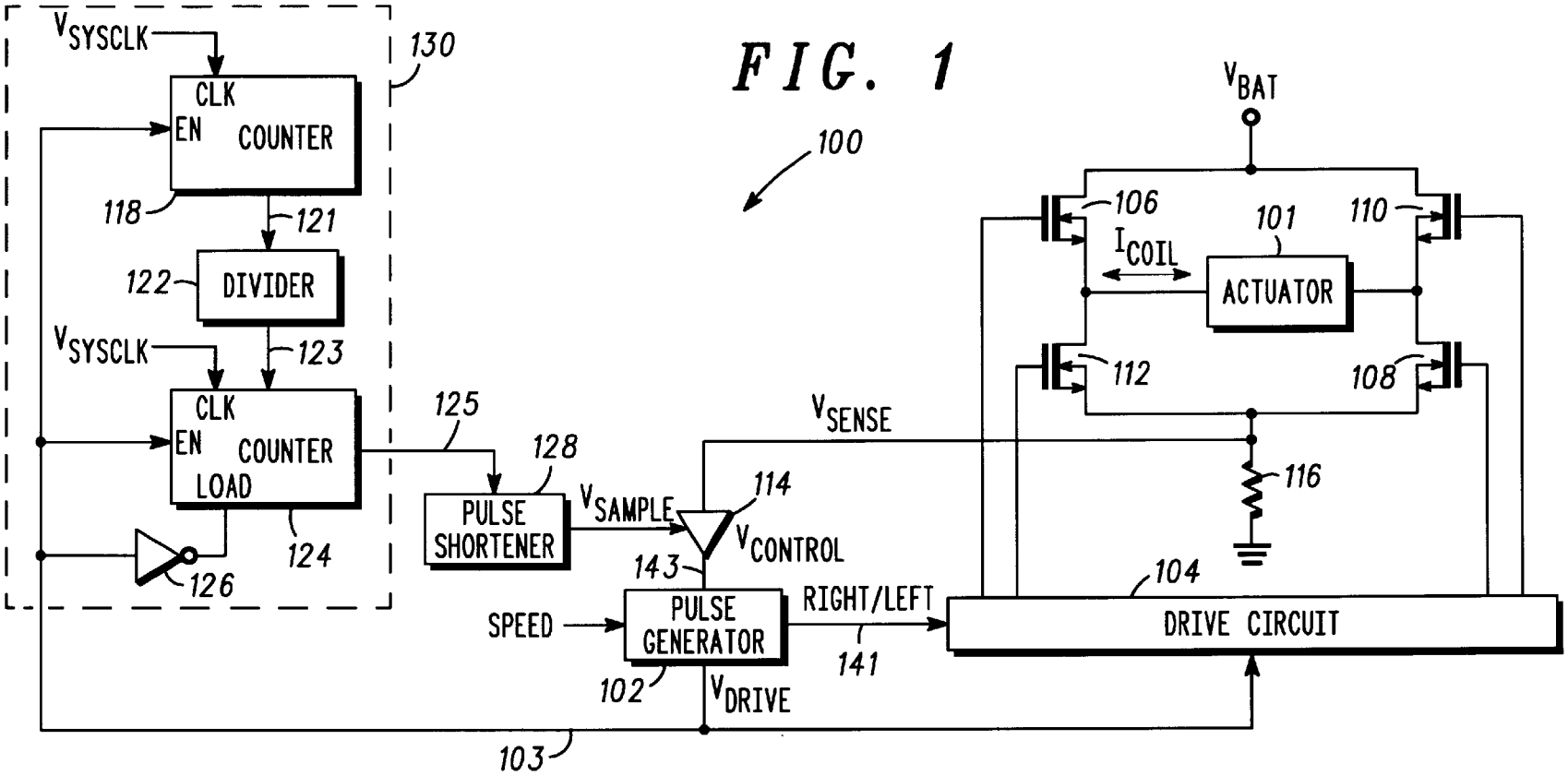
FIG. 1 schematically illustrates a linear actuator and a control circuit in accordance with the present invention.

FIG. 1 is a schematic diagram illustrating a control circuit 100 for driving a linear actuator 101 to displace an actuator piston (not shown) a distance proportional to the average value of a coil current $I_{COIL}$ of actuator 101. The components of control circuit 100 can be incorporated on a semiconductor die to produce an economical integrated control circuit. Actuator 101 is for use in a motor vehicle power steering system, and can also be used advantageously to control other types of electromechanical devices such as electric motors to produce a controlled linear or rotational displacement. Control circuit 100 operates from an automobile battery voltage $V_{BAT}$ of about thirteen volts.

In a power steering system, the actuator piston is deflected to alter the flow of hydraulic fluid to set the level of power steering assist to the vehicle. The amount of assist, and the piston deflection, depend on parameters such as the vehicle speed which change relatively slowly. In practice, these parameters are essentially constant over a given period of several hundred milliseconds.

A pulse generator 102 is implemented as a digital microcontroller which has an output 103 for providing a drive signal $V_{DRIVE}$ operating as a series of pulses for switching the $I_{COIL}$ current. Pulse generator 102 generates $V_{DRIVE}$ pulses at a four kilohertz rate. The desired $V_{DRIVE}$ pulse widths and $I_{COIL}$ direction vary with the vehicle speed, which is received from the vehicle by pulse generator 102 as a SPEED control signal. A RIGHT/LEFT control signal indicative of the $I_{COIL}$ direction is provided at an output 141. A control input at node 143 receives a control signal $V_{CONTROL}$ from a sense amplifier 114 to modulate the $V_{DRIVE}$ pulse widths over a 10%–90% range, from 25.0 to 225.0 microseconds. $V_{CONTROL}$ is an analog signal, so pulse generator 102 includes an analog to digital converter to convert $V_{CONTROL}$ to internal digital control data for more efficient processing.

The $V_{DRIVE}$ pulses are level shifted by a drive circuit 104 to provide output pulses for switching an H-bridge transistor network including transistors 106, 108, 110 and 112. Transistors 106–112 are switched in pairs to apply $V_{BAT}$ across actuator 101 in either direction. For example, to displace the piston to the right, transistors 106 and 108 are enabled so that $I_{COIL}$ flows from left to right through actuator 101. To displace the piston to the left, transistors 110 and 112 are enabled so $I_{COIL}$ flows from right to left. Transistors 106–112 are n-channel metal oxide semiconductor field effect transistors (MOSFET) formed in separate p-well regions disposed in an n-type substrate. The p-wells are biased to the respective sources to operate as clamping diodes. When transistors 106–112 are all turned off, the current induced by the coil's collapsing magnetic field is discharged through these clamping diodes. Transistors 106–112 are configured to switch up to four amperes of average $I_{COIL}$ current.

Transistors and other semiconductor devices used in control circuit 100 are understood to provide a conduction path between first and second conduction electrodes when a control signal is applied to a control electrode. For example, the first and second conduction electrodes correspond to the drain and source of a MOSFET, and the control electrode corresponds to the gate of the MOSFET.

The H-bridge network is coupled to ground through a sense resistor 116 as shown to provide a common reference with sense amplifier 114. Resistor 116 often is integrated on the semiconductor die with the other components of control circuit 100. However, when a precise resistance value is needed, resistor 116 can alternatively be an external resistor. As transistors 106–112 are switched, $I_{COIL}$ flows through resistor 116 to develop a proportional sense voltage $V_{SENSE}$. The resistance of resistor 116 is fifty milliohms, so the average value of $V_{SENSE}$ can be as high as two hundred millivolts.

Sense amplifier 114 is enabled by a sampling signal $V_{SAMPLE}$ to sense $V_{SENSE}$ at a time when $I_{COIL}$ flows at its average level. An output at node 143 feeds $V_{CONTROL}$ back to pulse generator 102 to modulate the $V_{DRIVE}$ pulse widths to maintain a desired average $I_{COIL}$ current level.

In the embodiment of FIG. 1, the average $I_{COIL}$ current flows at the midpoint of the $V_{DRIVE}$ pulses, so $V_{SAMPLE}$ is generated at the midpoint of each $V_{DRIVE}$ pulse. However, the midpoint of a particular $V_{DRIVE}$ pulse cannot be determined until its pulse width is known. The present invention avoids this problem by measuring the pulse width of one drive pulse and using the measurement to predict the midpoint of a subsequent drive pulse. Because vehicle speed changes slowly, successive $V_{DRIVE}$ pulse widths are practically equal, typically varying less than one percent. Consequently, the predicted midpoint is within one percent of its actual value and $I_{COIL}$ can be measured to a high degree of accuracy.

A timing circuit 130 is clocked by $V_{SYSCLK}$ to control when $V_{SAMPLE}$ is generated. Timing circuit 130 includes counters 118 and 124 operating as first and second timers, an inverter 126, and a divider circuit 122.

Figure 2:
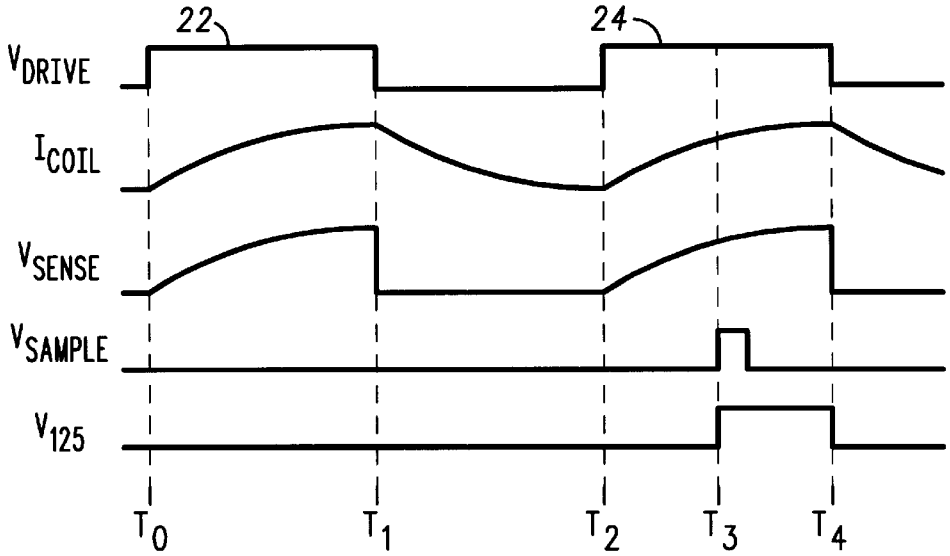
FIG. 2 illustrates a timing diagram for the linear actuator and control circuit of FIG. 1 in accordance with the present invention.

Referring to FIG. 2, a timing diagram illustrates the operation of timing circuit 130. Counter 118 is a binary up counter which is enabled by a first $V_{DRIVE}$ pulse 22. Counter 118 counts with $V_{SYSCLK}$ until first $V_{DRIVE}$ pulse 22 terminates at time $T_1$, thereby producing a value which is a measure of the pulse width of first $V_{DRIVE}$ pulse 22. The value is stored as a binary count at an output coupled to a node 121 and transferred to divider circuit 122 at the end of first $V_{DRIVE}$ pulse 22.

First $V_{DRIVE}$ pulse 22 is simultaneously applied to drive circuit 104 to produce $I_{COIL}$ during the $T_0$–$T_1$ interval, as shown in FIG. 2. Drive circuit 104 has symmetrical operation, so its operation can be described by assuming that first $V_{DRIVE}$ pulse 22 turns on transistors 106 and 108 to produce a left-to-right $I_{COIL}$ current flow through actuator 101. Note that the amplitude of $I_{COIL}$ varies during first $V_{DRIVE}$ pulse 22 from a minimum at $T_0$ to a maximum at $T_1$. During the $T_0$–$T_1$ interval, $I_{COIL}$ is routed through resistor 116 so that $V_{SENSE}$ tracks $I_{COIL}$.

At time $T_1$, first $V_{DRIVE}$ pulse 22 terminates, turning off transistor 108. Transistor 106 remains on as the magnetic field stored in the actuator coil collapses, discharging $I_{COIL}$ through transistor 106 and the clamping diode of transistor 110. $I_{COIL}$ decays to a minimum value at time $T_2$, when a second $V_{DRIVE}$ pulse 241 commences. From $T_1$ to $T_2$, $V_{SENSE}$ is substantially zero volts as $I_{COIL}$ is discharged through the clamping diode.

Divider circuit 122 is configured as a shift register whose input is coupled to node 121 to receive the binary count. Divider circuit 122 shifts right one stage to divide the binary count by two, producing a reduced value equal to one-half of the binary count for storing at a node 123. The reduced value defines a proportional time interval that is one-half the pulse width of first $V_{DRIVE}$ pulse 22. Note that divider circuit 122 can be configured to divide the binary count by a different number or, equivalently, to multiply it by a fraction. Such a configuration would generate a reduced count representing a proportional time interval shorter than the pulse width of first $V_{DRIVE}$ pulse 22. Such a proportional time interval is used to generate $V_{SAMPLE}$ during a second $V_{DRIVE}$ pulse 24 at a time other than its midpoint.

Counter 124 is a programmable down counter whose data input is coupled to node 123 to receive the reduced value from divider circuit 122. Counter 124 is enabled by second $V_{DRIVE}$ pulse 24 to initiate the proportional time interval at time $T_2$. Counter 124 is decremented with $V_{SYSCLK}$. As counter 124 decrements to zero at time $T_3$, the proportional time interval terminates and a pulse $V_{125}$ is generated at output 125. Since the pulse widths of first and second $V_{DRIVE}$ pulses 22 and 24 are practically equal, the midpoint of second $V_{DRIVE}$ pulse 24 essentially occurs as the proportional time interval terminates. Hence, $V_{125}$ is generated at the midpoint of second $V_{DRIVE}$ pulse 24 to sense $I_{COIL}$ at its average level. Consequently, timer circuit 130 can determine the average $I_{COIL}$ current level during second $V_{DRIVE}$ pulse 24 by taking only one measurement during first $V_{DRIVE}$ pulse 22.

A pulse shortener 128 operates as a differentiator that produces $V_{SAMPLE}$ as a shortened pulse on the leading edge of $V_{125}$ as shown in FIG. 2. The $V_{SAMPLE}$ pulse width is made short enough that the $V_{SENSE}$ variation during the pulse is not significant, so that an accurate value of $V_{CONTROL}$ is produced. In the embodiment of FIG. 1, the $V_{SAMPLE}$ pulse width is equal to one period of $V_{SYSCLK}$, or five hundred nanoseconds. Pulse shortener 128 is implemented with combinational logic, but alternatively can incorporate delay circuitry, monostable circuitry, or be configured as a relaxation oscillator. In systems in which successive $V_{DRIVE}$ pulse widths can vary widely, the proportional time interval can be longer than the subsequent $V_{DRIVE}$ pulse width, and an error could result from sensing $I_{COIL}$ when $V_{SENSE}$=0, i.e., after the subsequent pulse terminates. To avoid this problem, pulse shortener 128 can include circuitry to receive a signal from counter 118 to generate $V_{SAMPLE}$ at the end of the subsequent pulse from counter 124, which has not decremented to zero.

The sampling operation described above is cyclic in nature. Another cycle begins at time $T_2$ when counter 118 receives second $V_{DRIVE}$ pulse 24 and measures its pulse width. Divider circuit 122 produces a reduced value representing a second time interval shorter than the pulse width of second $V_{DRIVE}$ pulse 24. The second time interval is initiated with a third $V_{DRIVE}$ pulse to provide another $V_{SAMPLE}$ pulse as the second time interval terminates.

Figure 3:
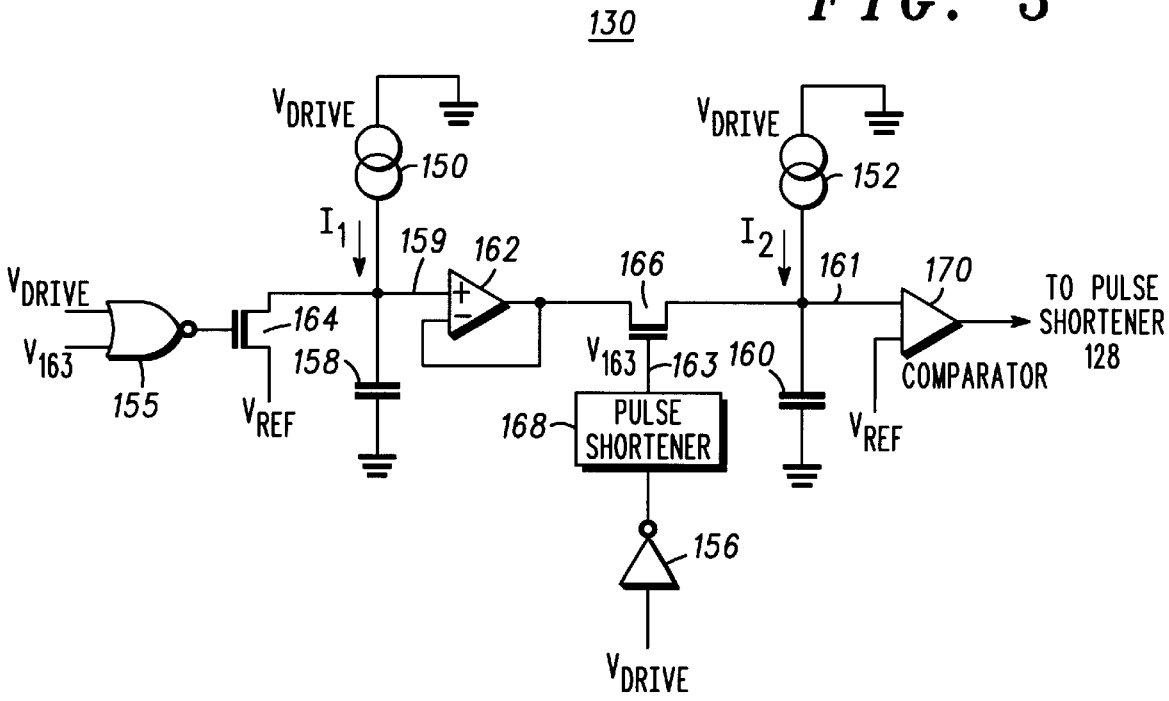
FIG. 3 schematically illustrates an alternate embodiment of a portion of a control circuit in accordance with the present invention.

FIG. 3 schematically illustrates timing circuit 130 in an alternate embodiment, comprising first and second timers or timer stages coupled together through a switching circuit. The first timer includes a switchable current source 150, a NOR gate 155, a switch 164 and a capacitor 158 coupled to a first storage node 159. The second timer includes a switchable current source 152, a capacitor 160 and a comparator 170 coupled to a second storage node 161. The switching circuit includes a buffer amplifier 162, an inverter 156, a switch 166, and a pulse shortener 168. Switches 164 and 166 include switching devices such as transmission gates which can transfer analog signals without loss or distortion.

In general terms, the first timer develops and stores a first voltage $V_{159}$ at first storage node 159 whose value is proportional to the pulse width of a $V_{DRIVE}$ pulse. At the end of the $V_{DRIVE}$ pulse, the switching circuit transfers $V_{159}$ to second storage node 161 of the second timer as a second voltage $V_{161}$. The value of $V_{161}$ represents a proportional time interval one-half that of the pulse width of the first $V_{DRIVE}$ pulse. A subsequent $V_{DRIVE}$ pulse initiates the proportional time interval and generates $V_{SAMPLE}$ as the proportional time interval terminates.

Figure 4:
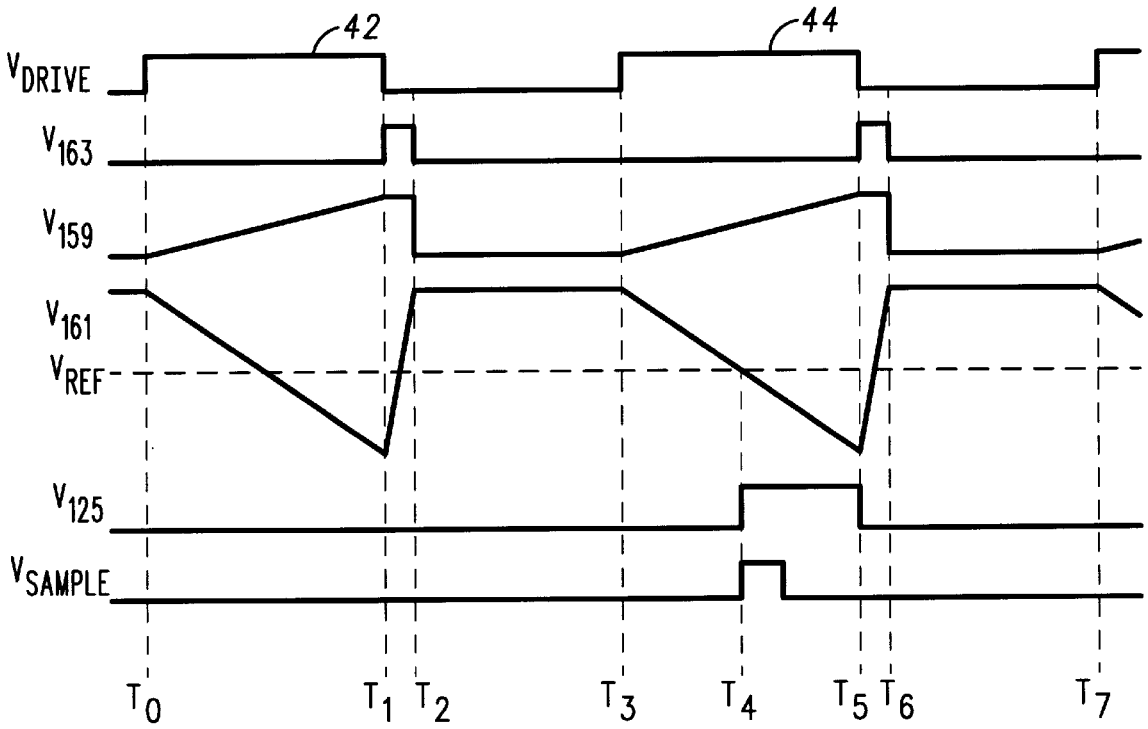
FIG. 4 illustrates a timing diagram. for the circuit of FIG. 3 in accordance with the present invention.

Detailed operation is best seen by referring to the timing diagram of FIG. 4. Initially, switch 164 of the first timer is closed to set $V_{159}$ equal to a reference voltage $V_{REF}$, and switch 166 is open. At time $T_0$, a first $V_{DRIVE}$ pulse 42 switches on current source 150 to charge capacitor 158 with a current $I_1$. When first $V_{DRIVE}$ pulse 42 terminates at time $T_1$, $V_{159}$ has a voltage value of $(I_1 * T_{PW}/C_{158})$, where $T_{PW}$ is the pulse width of first $V_{DRIVE}$ pulse 42 and $C_{158}$ is the capacitance of capacitor 158. Hence, the value of $V_{159}$ is proportional to $T_{PW}$. At time $T_2$, $V_{DRIVE}$ and $V_{163}$ are both at logic low levels, so the output of NOR gate 155 closes switch 164 to discharge capacitor 158 to repeat the cycle when a second $V_{DRIVE}$ pulse 44 is received.

Pulse shortener 168 provides a differentiating function similar to that of pulse shortener 128. A shortened pulse $V_{163}$ is produced at node 163, but at the trailing edge of first $V_{DRIVE}$ pulse 42 because $V_{DRIVE}$ is complemented by inverter 156. Pulse $V_{163}$ closes switch 166 from time $T_1$ to time $T_2$, long enough to charge capacitor 160 with amplifier 162.

Amplifier 162 is a unity gain buffer stage that interacts with switch 166 to isolate node 161 from node 159 during the $T_0$–$T_1$ interval. At time $T_1$, the voltage value of $V_{159}$ is transferred by amplifier 162 through switch 166 to node 161 for charging capacitor 160 to store the value as voltage $V_{161}$. In the embodiment of FIG. 3, capacitors 158 and 160 are matched to provide equal capacitances.

Current source 152 is switched on by a second $V_{DRIVE}$ pulse 44 to provide a current $I_2=2*I_1$ to discharge capacitor 160. The value of $V_{161}$ represents a time interval $T_{161}$ whose length is $T_{161}=C_{160}*V_{161}/I_2$, which is one-half the pulse width of first $V_{DRIVE}$ pulse 42. In effect, $I_2$ discharges node 161 in one-half the time of the pulse width of first $V_{DRIVE}$ pulse 42. Similar operation can be achieved with alternative configurations. For example, $I_1$ can equal $I_2$ while $C_{158}$ has one-half the capacitance of $C_{160}$.

Comparator 170 compares $V_{161}$ with $V_{REF}$ and produces an output pulse $V_{125}$ at time $T_4$ as $V_{161}$ discharges to the level of $V_{REF}$, as shown in FIG. 4. Since first and second $V_{DRIVE}$ pulses 42 and 44 are practically equal, time $T_4$ occurs at the midpoint of second $V_{DRIVE}$ pulse 44. $V_{125}$ is applied to pulse shortener 128 as previously described to generate $V_{SAMPLE}$ at time $T_4$.

At $T_5$, switch 166 closes to repeat the cycle by transferring a voltage from node 159 to node 161 at time $T_6$ to discharge capacitor 160 with a third $V_{DRIVE}$ pulse commencing at time $T_7$.

By now it should be appreciated that an improved circuit and method of controlling a coil current of an electromechanical device such as a linear actuator has been described. A first timer measures the pulse width of a first drive pulse and provides a proportional value. A second timer uses the proportional value to generate a time interval shorter than the pulse width of the first drive pulse. The second timer initiates the time interval with a second drive pulse and produces a sampling signal as the time interval terminates to sense the average coil current flow. Hence, the present invention can determine the average coil current with a single sample taken across a single external resistor. By sampling at a time when the average coil current is flowing, the present invention eliminates an external sense resistor and reduces the complexity of the current sensing circuit, which reduces the manufacturing cost in comparison to prior art control circuits.

What is claimed is:

1. An integrated circuit for controlling an electromechanical device, comprising:

a first timer having an input coupled for receiving drive pulses and an output coupled for transmitting a first count value that is indicative of a pulse width of a first drive pulse; and a second timer having a data input coupled to the output of the first timer and an output coupled for transmitting a pulse and coupled for controlling a current flow through a coil of the electromechanical device, wherein a first edge of the pulse occurs at a time between first and second edges of a second drive pulse and wherein a time interval between the first edge of the second drive pulse and the first edge of the pulse is shorter than the pulse width of the first drive pulse.

2. The integrated circuit of claim 1, wherein the first timer includes a first counter having an enable input responsive to the first drive pulse and a clock input for counting the pulse width of the first drive pulse with a clock signal to provide the first count value.

3. The integrated circuit of claim 2, wherein the second timer has an enable input coupled to the input of the first timer for initiating the time interval with the second drive pulse.

4. The integrated circuit of claim 3, wherein the first count value is loaded into the second timer as the first drive pulse terminates for forming the time interval with a second count value less than the first count value.

5. The integrated circuit of claim 4, wherein the second timer includes:

a divider circuit having an input coupled for receiving the first count value and a storage node for storing the second count value as a binary count; and a second counter having a data input coupled to the storage node for loading the binary count and a clock input for counting to the binary count with the clock signal to terminate the time interval.

6. The integrated circuit of claim 3, further comprising a drive circuit having an input responsive to the drive pulses and an output coupled to the coil to provide the current flow in response to the second drive pulse.

7. The integrated circuit of claim 3, further comprising a sense amplifier having an enable input coupled to the output of the second timer, a sense input for coupling to the coil to develop a sense signal indicative of the current flow, and an output for providing a feedback signal.

8. The integrated circuit of claim 1, wherein the first timer includes:

a capacitor coupled to a first storage node; and a current source operating in response to the first drive pulse for charging the first storage node with a first current to develop the first count value as a first voltage.

9. The integrated circuit of claim 8, wherein the second timer includes:

a switching circuit coupled to the first storage node for isolating the first voltage from a second storage node during the first drive pulse, and for transferring the first voltage to the second storage node as the first drive pulse terminates;

a second capacitor coupled to the second storage node; and a current source operating in response to a second drive pulse for discharging the second capacitor with a second current to generate the time interval.

10. The integrated circuit of claim 8, wherein the second timer includes a comparator having a first input coupled to the second storage node, a second input coupled for receiving a reference voltage, and an output coupled to the output of the second timer to provide a sampling signal as the second capacitor discharges to the reference voltage.

11. The integrated circuit of claim 8, wherein the first and second capacitors are matched and the second current is greater than the first current.

12. A circuit for controlling a coil current of an electromechanical device, comprising:

a timer having an enable input coupled for receiving drive pulses for measuring a pulse width of a first drive pulse and an output coupled for transmitting a sampling pulse, wherein a time interval between a first edge of a second drive pulse and a first edge of the sampling pulse is shorter than the pulse width of the first drive pulse, and wherein the time interval is initiated by the second drive pulse to provide the sampling pulse as the time interval terminates;

a sensing circuit enabled by the sampling pulse and having an input coupled to a first terminal of the electromechanical device for sensing the coil current and an output for providing a sense signal; and a drive circuit having an input coupled for receiving the drive pulses and an output coupled to a second terminal of the electromechanical device for switching the coil current in response to the second drive pulse.

13. A method for sensing current flow in a coil of an electromagnetic device, comprising the steps of:

measuring a pulse width of a first drive pulse to produce a first value that is representative of the pulse width of the first drive pulse; and generating a sampling pulse with the first value to sense the current flow in the coil of the electromagnetic device, wherein a first edge of the sampling pulse occurs at a time between first and second edges of a second drive pulse and wherein a time interval between the first edge of the second drive pulse and the first edge of the sampling pulse is shorter than the pulse width of the first drive pulse.

14. The method of claim 13, wherein the step of measuring includes the step of counting the pulse width of the first drive pulse with a clock signal to provide the first value as a binary count.

15. The method of claim 14, wherein the step of generating a sampling pulse includes the steps of:

counting to the binary count with the clock signal to terminate the time interval; and initiating the sampling pulse as the time interval terminates.

16. The method of claim 14, wherein the step of generating a sampling pulse includes the step of generating a second value less than the first value to represent the time interval.

17. The method of claim 16, further comprising the step of initiating the time interval with the second drive pulse.

18. The method of claim 17, wherein the step of generating a second value includes the step of dividing the binary count to produce the second value.

19. The method of claim 17, wherein the step of measuring includes the steps of:

switching a first current with the first drive pulse; and charging a first capacitance with the first current to store the first value as a first voltage.

20. The method of claim 19, wherein the step of initiating the time interval includes the steps of:

charging a second capacitance with a second current to develop a second voltage equal to the first voltage;

switching a second current with the second drive pulse to discharge the second capacitance; and comparing the second voltage with a reference voltage to establish the time interval.

* * * * *